United States Patent [19]

Hesener

[11] Patent Number: 4,590,642

[45] Date of Patent: May 27, 1986

[54] PIVOTAL HINGE FOR AN ARM OF AN AWNING

[75] Inventor: Karl Hesener, Finnentrop-Heggen, Fed. Rep. of Germany

[73] Assignee: Paul Voss GmbH u. Co., Fed. Rep. of Germany

[21] Appl. No.: 675,216

[22] Filed: Nov. 27, 1984

[30] Foreign Application Priority Data

Jun. 16, 1984 [DE] Fed. Rep. of Germany ..... 3422449

[51] Int. Cl.[4] ..... E05D 7/06

[52] U.S. Cl. ..... 16/241; 16/245; 16/252; 16/338; 160/22; 160/81

[58] Field of Search ..... 16/279, 240, 241, 242, 16/245, 246, 252, 253, 337, 338, DIG. 41; 160/22, 29, 30, 31, 72, 73, 77, 81

[56] References Cited

U.S. PATENT DOCUMENTS

| | | | |
|---|---|---|---|
| 1,798,856 | 3/1931 | Simon | 160/81 X |
| 3,058,795 | 10/1962 | Siegel et al. | 16/337 X |
| 3,782,443 | 1/1974 | Clauss et al. | 160/22 |

FOREIGN PATENT DOCUMENTS

| | | | |
|---|---|---|---|
| 2752872 | 5/1979 | Fed. Rep. of Germany | 160/22 |
| 2713626 | 10/1979 | Fed. Rep. of Germany . | |
| 2834486 | 2/1980 | Fed. Rep. of Germany | 160/22 |
| 2909306 | 9/1980 | Fed. Rep. of Germany . | |
| 2443596 | 4/1981 | Fed. Rep. of Germany . | |
| 8200939 | 7/1982 | Fed. Rep. of Germany . | |
| 3206963 | 9/1983 | Fed. Rep. of Germany . | |
| 483001 | 4/1938 | United Kingdom . | |
| 2042058 | 9/1980 | United Kingdom | 160/72 |

*Primary Examiner*—Fred Silverberg
*Attorney, Agent, or Firm*—Bacon & Thomas

[57] ABSTRACT

A pivotal hinge for an arm of an awning, wherein a supporting block is tightly clamped on a rectangular supporting tube and carries a pivotal bracket swingable and lockable about an axle disposed in parallel with the supporting tube. The pivotal hinge is adjustable in a simple manner by a readily available tool and has high stability, particularly rigidity against torsion. The supporting block is defined by a yoke including two legs joined by a central web, one leg being defined by two parallel webs and a cross web connecting same. A supporting trunnion is carried within a pair of eyes formed in spaced projections extending beyond the central web for pivotally supporting the pivotal bracket. A threaded sleeve is rotatably supported in a guide passage provided in the cross web, with a threaded bolt being engaged through the threaded sleeve and having one end pivotally connected to the pivotal bracket.

5 Claims, 5 Drawing Figures

PIVOTAL HINGE FOR AN ARM OF AN AWNING

BACKGROUND OF THE INVENTION

1. FIELD OF THE INVENTION

The invention relates to a pivotal hinge for an arm of an awning, wherein a supporting block is adapted to be clamped tightly on a rectangular supporting tube and carries a pivotal bracket swingable and lockable about an axle disposed in parallel with the supporting tube.

2. DESCRIPTION OF THE PRIOR ART

Such a folding arm awning according to the DE-PS No. 24 43 596 which is built up on a rectangular supporting tube has proved itself efficient due to its stable and solid design. The pivotal hinges are clamped tightly on the rectangular supporting tube. In order that the inclination of the folding arms can be adjusted, it is necessary that these pivotal hinges are pivotable about the axis of the rectangular supporting tube. This requires a generally complicated and expensive structures having concentric ring arrangements. The adjustment of the inclination is complicated because several screws need to be loosened. After the loosening of the screws, the setting of the folding arms is effected. In its connection the entire arrangement is very unstable so that this adjustment requires much skill to implement. Finally, it is necessary to thereafter tighten the screws.

The DE-PS No. 27 13 626 describes a folding arm awning where two pivot hinges are coupled by a tube which may be actuated by a gearing. This construction is very complicated and expensive.

It is the object of the present invention to provide a pivotal hinge which is adjustable in a simple manner by a readily available tool and which has high stability, particularly rigidness against torsion.

SUMMARY OF THE INVENTION

This object is solved in the supporting block being defined as a yoke, one leg of which comprises two parallel webs and a crossweb connecting same on their outer ends, a supporting trunnion carried in eyes projecting beyond the central web about opposite to said webs for the reception of a pivotal bracket, the pivotal bracket pivotally receives a threaded bolt situated between the webs and that the threaded bolt engages a threaded sleeve which is rotatably arranged in a receiving chamber of the crossweb. This pivotal hinge differs from the prior art in a non-obvious manner in that the inclination is adjustable by moving a threaded bolt in a rotatable threaded sleeve. The rotation of the threaded sleeve may be carried out by a wrench-like tool. The arrangement of the threaded bolt in the threaded sleeve is self-locking so that a securing of the adjustment is not necessary. The inclination may be adjusted at any time. Thereby the inclination is unequivocally determined even during the adjusting period. An inclination range of 45° in regard to the horizontal direction is possible without any difficulties. The pivotal hinge has a very stable construction. It consists of a yoke-like angular arrangement. The pivotal bracket is arranged between the eyes of the supporting block and is thereby cant-safely guided in case of great forces, particularly transverse force. The threaded bolt is placed between the webs in a groove or in a slot. By the mutual guidance of the parts and the solid journals a high stability of the pivotal hinge results and particularly a high stiffness against torsion so that the pivotal hinge is adapted to withstand all operational loads.

A stable configuration and increase of the stiffness against torsion is realized by a bearing trunnion being carried in eyes of the pivotal bracket for the pivotal reception of the threaded bolt and that the threaded bolt extends approximately in the center between the two webs of the leg.

One kind of the arrangement of the threaded bolt is characterized in that the trunnion receives an eye of the threaded bolt.

Another arrangement with simple mountability is effected in that the trunnion comprises a cross-passage for the threaded bolt and that the threaded bolt abuts the trunnion by a head collar. Consequently, a particular locking or screwing of the trunnion is not necessary.

The mountability is made easier in that the supporting block comprises rectangularly to the passage for the trunnion a further passage for the head of the threaded bolt and in addition adjacent to the further passage a recess for the swivelling of the head.

An easy and secure adjustment is effected in that the threaded sleeve comprises a polygonal flange. In this case a setting of the inclination is possible by means of a readily available engineer's wrench.

For an additional security against displacement the invention provides a cup spring disposed between a front surface of the polygonal flange and the crossweb.

The safeguarding of the adjusting device against undesired adjustment or against a coming out of the guides is improved in that the receiving chamber of the crossweb is provided as a semicylindrical groove, that the threaded sleeve comprises matching flanges on both ends of a tube part, which flanges abut on the front surfaces of the groove, and that the crossweb comprises a guide passage for the threaded bolt. Even in the case of shock loads of the awning by wind forces or the like the pivotal hinge cannot be accidentably displaced, thereby preventing damage to the awning.

Additional safeguarding is effected in that a helical pressure spring pretensions one matching flange of the threaded sleeve against the associated front surface of the groove.

The clamping of the arm bearing on the rectangular supporting tube is realized in that on the ends of the webs passages are provided for screws which engage the opposed leg and clamp tightly the supporting block on the rectangular supporting tube.

BRIEF DESCRIPTION OF THE DRAWINGS

One embodiment of the invention will be described in the following description with reference to the accompanying drawings, wherein.

DESCRIPTION OF THE PREFERRED EMBODIMENT

Figure 1:
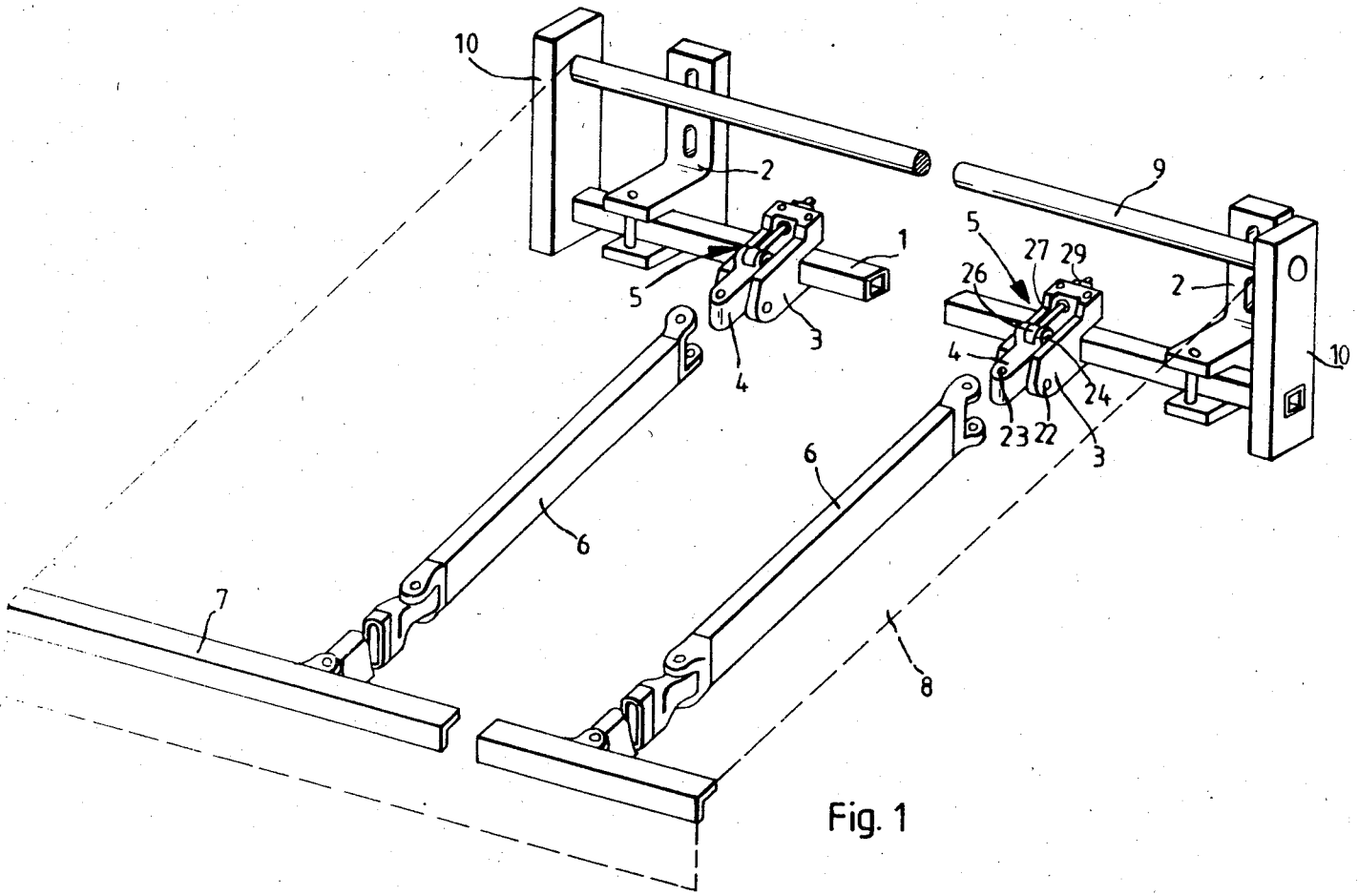
FIG. 1 is a prespectivic view of a folding arm awning with pivotal hinges and folding arms.

A folding arm awning comprises a rectangular supporting tube 1, which is supported in hangers 2 which can be fastened on the wall or on another supporting means. The rectangular supporting tube 1 is the carrying element for the structure of the entire awning. On the rectangular supporting tube supporting blocks 3 are clamped tightly which carry in each case a pivotal bracket 4 having a passage 23 for the bearing of a folding arm 6. In each case a supporting block 3 and a pivotal bracket 4 form a pivotal hinge 5. Normally two pivotal hinges are present. On the outer end of the folding arms 6 a front pole 7 is provided. On the front pole 7 the blind fabric 8 is fastened which is wound up on a fabric roller 9 on the other side. The fabric roller 9 is supported in bearing trestles 10 which are also fastened on the rectangular supporting tube 1. The drive elements for the fabric roller 9 are not shown.

Figure 2:
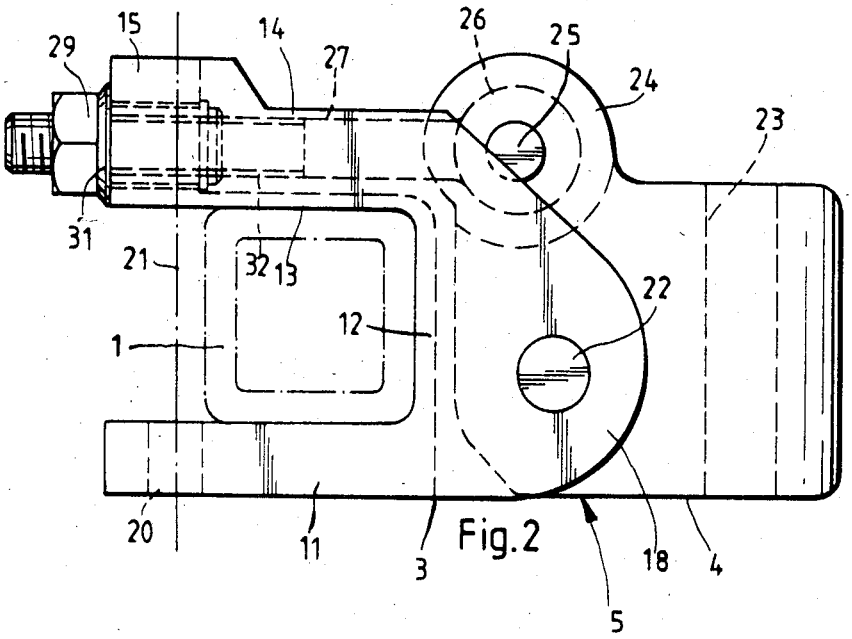
FIG. 2 is a side view of a pivotal hinge.
Figure 3:
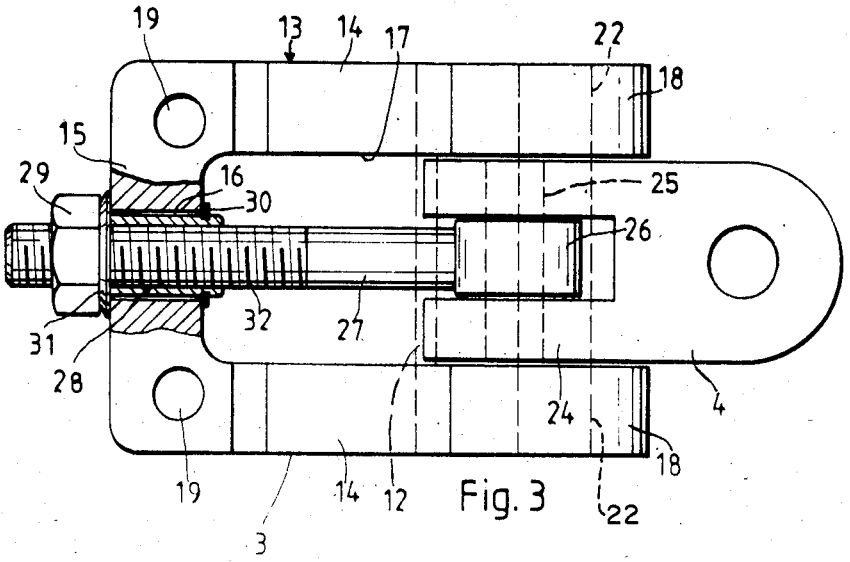
FIG. 3 is a top view of the pivotal hinge shown in FIG. 2.

FIG. 2 and 3 show a first embodiment of a pivotal hinge 5. The supporting block 3 of the pivotal hinge 5 is designed as a yoke. A leg 11, central web 12 and a further leg 13 surround the rectangular supporting tube 1. The leg 13 comprises two webs 14 extending in parallel with each other which are on the outer ends connected with each other by a crossweb 15. Thereby a groove 17 or a slot is provided between the web 14. In the crossweb 15 a passage 16 is provided, which is directed to the groove 17 between the webs 14. On the central web 12 two eyes 18 project which also form guide walls. On the ends of the webs 14 passages 19 are provided which are in alignment with the passages 20 in the leg 11. These passages receive screws 21 or other clamping devices which are schematically shown in FIG. 2 and which serve for the clamping of the supporting blocks 3 on the rectangular supporting tube 1.

The eyes 18 carry a supporting trunnion 22, on which the pivotal bracket 4 is pivotably arranged. The pivotal bracket 4 is guided canting-proof between the guide walls of the eyes 18 and on the supporting trunnion 22.

The pivotal bracket 4 is a substantially rectangular part and comprises on the front end a passage 23 for receiving a journal pin, not shown, for a folding arm 6. On the upper end, opposite to the supporting trunnion 22, two eyes 24 opposed to each other are formed which carry a bearing trunnion 25.

An eye 26 of a threaded bolt 27 is pivotably arranged on the bearing trunnions 25. The threaded bolt 27 extends approximately in parallel with the webs 14 within the slot or the groove 17. The threaded bolt 27 engages with a thread portion 32 a threaded sleeve 28, which is situated within the passage 16. On one end the threaded sleeve 28 comprises a polygonal flange 29 which enables a rotation of the threaded sleeve 28. Between a front surface of the polygonal flange 29 and the front surface of the crossweb 15 is arranged a cup spring 31 which produces an additional clamping force and frictional force. On the other end the threaded sleeve is secured by a Seeger circlip ring 30 in the axial direction. The outer diameter of the threaded sleeve 28 is smaller than the inner diameter of the passage 16 so that the threaded sleeve 28 can move and displace within the passage. Due to the fact that the threaded sleeve 28 is secured against a displacement in both moving directions, thereby the folding arms of the awning are held in a stable manner so that the blind fabric cannot strike up.

If the polygonal flange 29 is rotated, the threaded bolt 27 is displaced in a screwing manner within the threaded sleeve 28. Accordingly the pivotal bracket 4 is pivoted about the supporting trunnion 22. The friction in the constructional elements and the additional force by the cup 31 spring is so large that an unintended displacement is not possible. Consequently a positive locking of the threaded sleeve 28 against rotation is not necessary. By rotating on the polygonal flange 29 the pivotal bracket 4 can be adjusted in a very simple manner. The inclination of the folding arms and thus the inclination of the blind fabric can be adjusted easily. A pivoting range of more than 45° in regard to the horizontal direction can be reached by the pivotal hinge according to the present invention. This is absolutely sufficient in practice. For the user an adjustment of the inclination is possible by a wrench. It is not necessary to loosen any fastening elements. The inclination is adjustable in any extended condition of the blind fabric and is unequivocally determined in any condition so that the awning cannot displace unintentionally its inclination. The threaded bolt 27 is protected against injurious effects between the webs 14. The pivotal bracket 4 is laterally guided in its entire pivoting range by the guide walls of the eyes 18 and thus is secured against canting. An inadmissible load of the supporting trunnion 22 is avoided. By the stable and solid construction and the mutual guidance of the elements a high stiffness against torsion is guaranteed.

Figure 4:
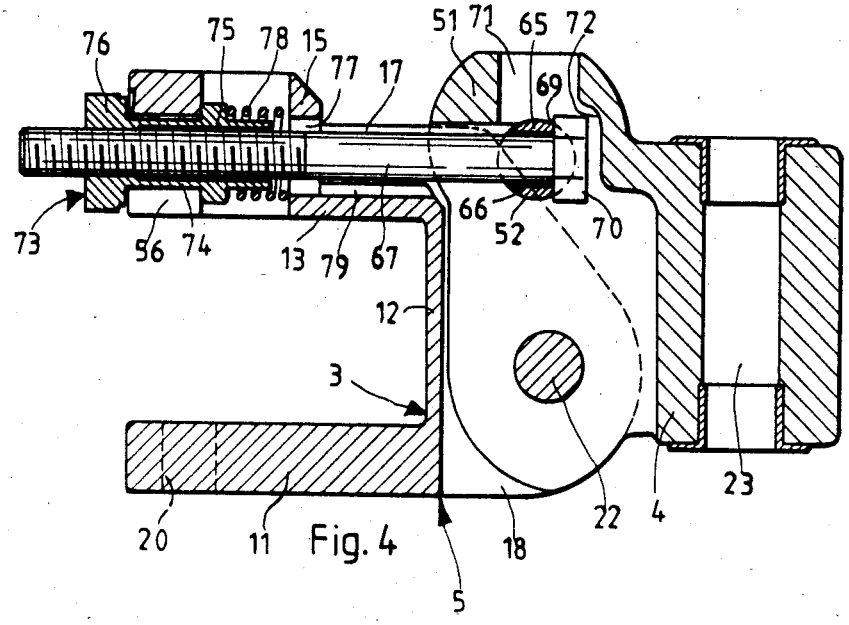
FIG. 4 is a section through a modified embodiment of a pivotal hinge.
Figure 5:
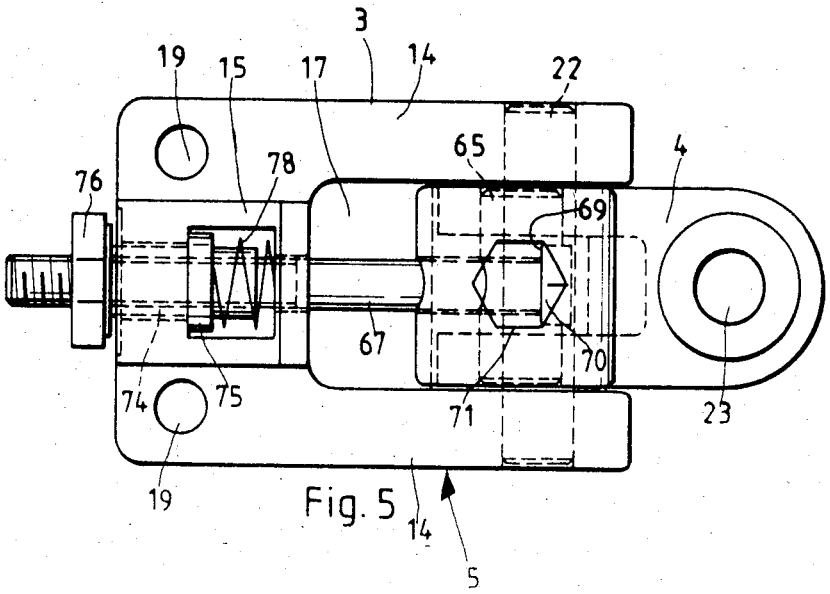
FIG. 5 shows a top view of the pivotal hinge shown in FIG. 4.

FIGS. 4 and 5 show a modified embodiment of the pivotal hinge. Same structural parts are provided with the same reference numbers.

The pivotal bracket 4 comprises in the head portion 51 a passage 52 for the bearing trunnion 64. The bearing trunnion 65 for its part comprises a cross-passage 66 which receives the threaded bolt 67. The threaded bolt 67 comprises a head 70, which abuts the bearing trunnions 65 by a head collar 69. In the head portion 61 oriented transversely to the bearing trunnion 65 a passage 71 is provided adapted to the transverse dimensions of the head 70 followed by a recess 72. It is clearly evident from FIG. 4 that the threaded bolt 67 is mountable by introduction into the passage 71 and swivelling of the head into the recess 72 within the pivotal bracket 4. The head portion 51 comprises further recesses which enable a swivelling of the threaded bolt 67 to the position as shown.

The threaded bolt 67 is guided in a guide passage 77 of the crossweb 15. In this case the reception into the crossweb 15 is provided as a semicylindrical groove 56. The threaded sleeve 73 comprises a central tube portion 74 which fills substantially the cross-section of the groove 56 and in each case on the ends matching flanges 75 and 76 which are in contact with the front surfaces of the groove 56. Thereby the threaded sleeve 73 is protected against an axial displacement in both directions. The matching flange 76 simultaneously is a polygonal flange for the rotation of the threaded sleeve 73. A helical pressure spring 78 pretensions the matching flange 75 against the adjacent front surface of the crossweb 15 in order to provide a higher friction and a protection against unintended displacement.

This embodiment of the invention allows a similar adjustment of the pivotal bracket 4 as the embodiment described above. The adjustment is carried out by rotating the threaded sleeve 73 and thus axial displacing of the threaded bolt 67. The threaded sleeve 73 is positively guided within the groove 56 and on the front walls thereof and is supported towards both adjusting directions of the threaded bolt 67. A springing out of the threaded sleeve 73 from the groove is not possible because of the guide passage 77 and the guide wall 79 of the leg 13. Thus the threaded bolt 67 with the threaded sleeve 73 is always kept in engagement with the groove 56. The pivotal bracket 4 and thus the specific folding arm of the awning therefore are held in a stable condition. Consequently the awning is secured against any unintentional displacement, for example, under wind load.

We claim the following:

1. A pivotal hinge for an arm of an awning of the type wherein a supporting block is tightly clamped onto a rectangular supporting tube and carries a pivotal bracket that is swingable and lockable about an axle disposed in parallel with the supporting tube, said hinge comprises:

(a) the supporting block being in the configuration of a yoke including two legs joined by a central web, with one leg being defined by a pair of parallel webs;

(b) a cross web connecting the parallel webs, the cross web including a semicylindrical groove formed between a pair of front surfaces, and a guide passage;

(c) a pair of projections extending beyond the central web, with a pair of spaced eyes formed in the projections;

(d) said axle being a supporting trunnion disposed in the pair of eyes;

(e) said pivotal bracket supported on the supporting trunnion;

(f) a threaded sleeve rotatably supported in the semicylindrical groove, the sleeve including a pair of spaced flanges which abut the front surfaces of the groove;

(g) a helical spring tensioning one flange of the threaded sleeve against its corresponding front surface; and (h) a threaded bolt engaged through the threaded sleeve and guide passage, the bolt including one end pivotally connected to the pivotal bracket.

2. The pivotal hinge of claim 1 wherein the other flange of the threaded sleeve is of a polygonal configuration.

3. The pivotal hinge of claim 1 wherein the legs are provided with means for clamping the supporting block onto the rectangular supporting tube.

4. The pivotal hinge of claim 1 wherein the pivotal bracket includes a passage, a bearing trunnion disposed within the passage, a cross passage formed in the bearing trunnion, and the one end of the threaded bolt being disposed through the cross passage.

5. The pivotal hinge of claim 4 wherein the one end of the threaded bolt includes a head and a head collar, and wherein the head collar abuts the bearing trunnion.

* * * * *